United States Patent [19]

Ridgeway

[11] 4,006,687

[45] Feb. 8, 1977

[54] SAFE DETONATOR DEVICE

[75] Inventor: John Jerold Ridgeway, Paris, France

[73] Assignee: Imperial Chemical Industries Limited, London, England

[22] Filed: Nov. 15, 1974

[21] Appl. No.: 524,269

[52] U.S. Cl. ..... 102/28 R; 102/DIG. 9

[51] Int. Cl.[2] ..... F42B 3/12

[58] Field of Search ..... 102/28, DIG. 9; 149/91

[56] References Cited

UNITED STATES PATENTS

| | | | |
|---|---|---|---|
| 2,929,325 | 3/1960 | Lewis | 102/DIG. 9 |
| 3,188,914 | 6/1965 | Dahl | 102/28 |
| 3,334,053 | 8/1967 | Audrieth | 149/91 |
| 3,580,171 | 5/1971 | Maes | 102/DIG. 9 |
| 3,719,144 | 3/1973 | Tlam | 102/DIG. 9 |

*Primary Examiner*—Verlin R. Pendegrass
*Attorney, Agent, or Firm*—Cushman, Darby & Cushman

[57] ABSTRACT

A detonator device comprising an initiator located in contact with an insensitive liquid component of a two-component liquid explosive composition in a container, the container having ullage space for the subsequent addition of a second liquid component, and being sufficiently strong to contain the pressure of any premature detonation of the initiator.

21 Claims, 1 Drawing Figure

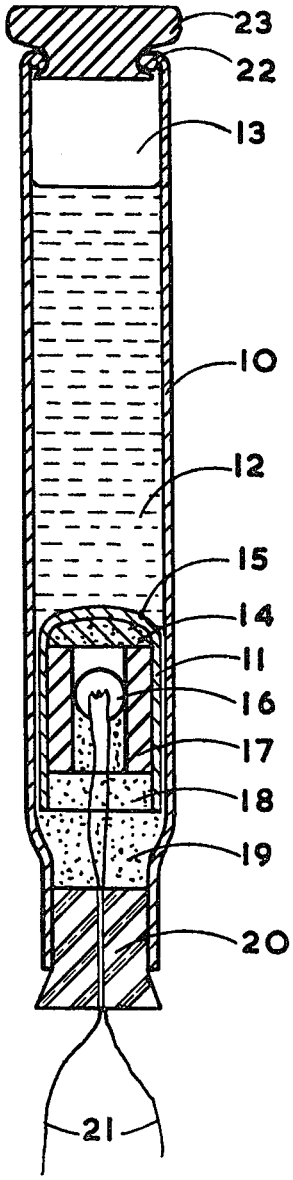
23
22
13
10
12
15
14
11
16
17
18
19
20
21

SAFE DETONATOR DEVICE

This invention relates to a detonator device for blasting explosives, which is transportable in a safe condition but is readily converted to a powerful detonator when required for the initiation of a blasting explosive composition.

There is an increasing need for a blasting system which can be safely and quickly transported by aircraft to remote areas of the world. Blasting explosive compositions suitable for this purpose are those which can be prepared from safely transportable non-self-explosive components by mixing the components at the blasting site. Such compositions commonly comprise two liquid components or a liquid and a granular solid, and making these available at a remote site is usually straightforward. However, these maincharge blasting compositions require initiators such as blasting caps comprising a primary initiating explosive and initiators can be accidentally detonated by inadvertent impact, friction, stray electric currents or radio signals. There are therefore strict regulations governing the transport of initiating devices which can delay their delivery to the blast site and may render the use of explosives in a project uneconomical.

Proposed solutions to the problem of transporting initiators included encapsulating a blasting cap in a protective housing of sufficient volume and strength to contain the explosive force in the event of accidental initiation of the cap. To avoid unreasonably large housings, the charge of initiating explosive was kept to a minimum. The practical devices were therefore only suitable for use with detonating cord end-butted against the initiating charge and were not sufficiently strong for reliable high velocity initiation of bulk blasting explosive. A proposal to improve the strength of the device was the detonator described in U.S. Pat. No. 3,580,171 in which the encapsulated initiator was surrounded by a protective layer of a solid non-self-explosive granular component of a two-component explosive which was subsequently sensitised to a detonatable composition by the addition of a liquid component. However it is very difficult in practice to achieve the intimacy of mixing of the solid and liquid components which is necessary for reliable initiation by a small initiating charge. The liquid has necessarily to be added to the solid at some distance from the initiator and, because of adsorption, it will not percolate uniformly to all portions of the solid. The composition in contact with the initiator is therefore variable and very strict control of the particle size of the solid material is necessary to achieve a composition which can be successfully initiated by the initiating charge.

I have discovered that a reliable safely transportable detonator device can be made by putting a quantity of a liquid component of a two-liquid component explosive in contact with the initiating charge and subsequently adding and mixing the second liquid component to form a sensitive explosive. Such a liquid mixture is very readily mixed to a uniform composition which is easier to initiate than a solid/liquid mixture. The liquid component also provides as good or better protection for the initiator as a solid component.

This device can be safely transported to a blast site by any transport means including air transport and, on the addition of the second liquid component, forms a very powerful detonator which can be used to initiate explosives made from non-self-explosive ingredients at the site.

Accordingly, a detonator device of this invention comprises electrically actuated explosive initiator means located in a container in contact with a first liquid component of a two-component liquid explosive composition, said first component being incapable of ignition by said initiator means but said liquid explosive being detonatable by said initiator means, said container being of such capacity to provide ullage space to enable a second liquid component, mixable with said first component to form the two-component liquid explosive, to be added to said first component and mixed therewith in the container, the strength of the container being sufficient to contain the pressure generated by the initiator means in the event of premature detonation thereof. The strength of the initiator means must therefore be limited so that on accidental detonation it transmits no dangerous explosive force outside the container although it may expel the liquid in a harmless manner.

The preferred first liquid component of the device is a nitroparaffin, for example nitromethane, and the complementary component may comprise liquid amines, for example hydrazine, benzylamine and ethylene diamine.

Compositions requiring only 70 milligrams of lead azide can be prepared by sensitising nitromethane with anhydrous hydrazine and accordingly a preferred device comprises an initiator means having 70 to 100 milligrams of lead azide in contact with nitromethane. The lead azide is preferably compressed to a pressure of 15,000 to 20,000 psi and may conveniently be contained in a metal cup. For ignition of the lead azide the initiator means conveniently comprises a conventional electric fusehead having a bead of incendiary composition and electric heating means to ignite the incendiary composition. The invention also includes the aforedescribed detonator device in which the second liquid component has been added to the first liquid component and mixed therewith, thereby forming a strong detonator for initiating blasting explosives.

From a further aspect the invention consists in a method of providing a strong detonator at a blasting site, which method comprises transporting to the site a detonator device of the invention and adding to the first liquid component, and mixing therewith in the container of the device, a second liquid component to produce a liquid explosive composition within the said container. The second liquid component may be transported entirely separate from the safe detonator device of the invention but is is generally convenient to provide this component packed in the individual amount appropriate for addition to an individual detonator device and to transport the package along with the detonator devices. In the preferred method the second component is provided in a container packaged with the device in a two-component package and, accordingly, the invention also includes a two-component safe package in which one component comprises the safe detonator device of the invention and the second component comprises a quantity of liquid which, when added to the liquid in the container of the device and mixed therewith, produces in the container a liquid explosive composition.

As a further precaution against the hazard of a lost detonator, a delayed acting sterilising agent may be incorporated into one or both components of the detonator. Thus, where the first component is nitroparaffin and the second component comprises hydrazine, the incorporation into the second component of about 5% by weight of the total explosive composition of diethylenetriamine ensures that the liquid explosive will become incapable of detonation by the initiator means about 6 hours after mixing.

The invention is further illustrated by the device which is hereinafter described, by way of example only, with reference to the accompanying drawing which shows, diagrammatically, a longitudinal section of a detonator device of the invention.

The device comprises a tubular container 10, closed at both ends, containing an electric initiator 11 and a non-self-explosive liquid component 12 of a two-liquid component explosive composition. The capacity of the container 10 provides ullage space 13 to permit the second liquid component to be added to the container 10 when the detonator device is to be used.

The initiator 11 comprises a charge of initiating explosive 14 compressed in the base of a metal cup 15, and electric fusehead 16 juxtaposed to the charge 14 and a plastics sleeve 17 surrounding the fusehead 16. The sleeve 17 and the fusehead 16 are bonded in the cup 15 by a cement composition 18. The cup 15 is located by cement composition 19 in one end of the container 10 and this end of the container is closed by crimping around a rubber plug 20, electric leading wires 21 connected to the fusehead 16 being trained through a perforation in the plug 20. The other end of the container 10 is provided at the lip with an internal bead 22 and a removable rubber stopper 23 engaged by the bead 22.

In one specific example the initiator contains, as initiating explosive 14, a charge of 100 milligrams of lead azide compressed at 19,000 psi in an aluminium cup 15 having an internal diameter 5/16 inch and a wall thickness of 0.028 inch. The container 10 is 0.028 inch thick aluminium and is ⅜ inch internal diameter.

The liquid component 12 is 8.5 g of nitromethane and the ullage space is about 2 cc.

Premature explosion of the initiator 11 of this device merely results in the nitromethane being expelled from the container 10 without risk of injury to personnel.

When the device is required to initiate a charge of blasting explosive, the stopper 23 is removed, 1.5 g of anhydrous hydrazine is added to the nitromethane in the container, the stopper 23 is replaced and the contents of the container mixed by gentle shaking. The resulting detonator is a very powerful initiator for blasting explosives. If a self-sterilising detonator device is desired, the second component may contain 1.0 g of hydrazine and 0.5 g diethylenetriamine.

What is claimed is:

1. In a detonator device an elongated container defining an elongated chamber, removable stopper means closing one end of said container, said stopper means having an outer end portion which projects outwardly of said container to facilitate removal of the stopper means, explosive initiator means located in the other end of the elongated chamber in contact with a first liquid component of a two-component liquid explosive composition, the space between said initiator means and said stopper constituting the major portion of said chamber and being essentially unobstructed except for said first liquid component and of such capacity to provide ullage space to enable a second liquid component, mixable with said first component to form the two-component liquid explosive, to be added upon removal of the stopper, to said first component and mixed therewith in the container, the strength of the container being sufficient to contain the pressure generated by the initiator means in the event of premature detonation thereof and to transmit said pressure to the stopper so that the latter and the first component are expelled from the container.

2. A device as claimed in claim 1 wherein the said first liquid component comprises a nitroparaffin.

3. A device as claimed in claim 2 wherein the nitroparaffin comprises nitromethane.

4. A device as claimed in claim 1 wherein the initiator means comprises lead azide and electrically actuated ignition means thereof.

5. A device as claimed in claim 4 wherein the initiator means comprises 70 to 100 milligrams of lead azide and the said first liquid component is nitromethane.

6. A device as claimed in claim 4 wherein the lead azide is compressed to a pressure of 15,000 to 20,000 psi.

7. A device as claimed in claim 4 wherein the lead azide is contained in a metal cup.

8. A strong detonator for blasting explosives comprising a device as claimed in claim 1 having a second liquid component admixed with the said first liquid component to form a liquid explosive composition within the device.

9. A detonator as claimed in claim 8 wherein the said second liquid component comprises a liquid amine.

10. A detonator as claimed in claim 9 wherein the liquid amine is selected from the group consisting of hydrazine, benzylamine and ehtylene diamine.

11. A detonator as claimed in claim 8 comprising additionally a delayed acting sterilising agent in said chamber.

12. A detonator as claimed in claim 11 wherein the first liquid component comprises nitroparaffin, the second liquid component comprises hydrazine and the delayed acting sterilising agent comprises diethylenetriamine.

13. A method of providing a strong detonator at a blasting site, which method comprises transporting to the site a detonator device as claimed in claim 1 and adding to the said first liquid component, and mixing therewith in the said container, a second liquid component to produce a liquid explosive composition within the said container, said liquid explosive composition being detonatable by the initiator means of the detonator device.

14. A method as claimed in claim 13 wherein the second liquid component is packed in the individual amount appropriate for addition to an individual detonator device and transported to the site together with the detonator device.

15. A method as claimed in claim 14 wherein the detonator device and an appropriate amount of said second liquid component are packaged in a two-component package for transport.

16. A method as claimed in claim 13 wherein one or both said liquid components has incorporated therein a delayed acting sterilising agent.

17. A method as claimed in claim 13 wherein the first liquid component in the detonator device in nitroparaffin and the second liquid component comprises a mixture of hydrazine and diethylenetriamine.

18. A two-component package comprising, in one component, a detonator device as claimed in claim 1 and, in a second component, a quantity of liquid which, when added to the liquid in the device of the first component and mixed therewith, produces a liquid explosive composition.

19. A detonator device as in claim 1 wherein said explosive initiator means includes 70 to 100 milligrams of lead azide compressed by a pressure of 15,000 to 20,000 psi and contained in a metal cup and electrically actuated ignition means for the lead azide, and wherein said first liquid component includes nitromethane and is incapable of ignition by said initiator means.

20. A detonator device comprising electrically actuated explosive initiator means located in a container in contact with a liquid explosive composition which is detonatable by said initiator means, said composition being a mixture of a first liquid component which is incapable of ignition by said initiator means with a second liquid component and with a delayed acting sterilizing agent, said container being of such capacity to provide ullage space to enable said second liquid component to be added to said first component and mixed therewith in the container, the strength of the container being sufficient to contain the pressure generated by the initiator means in the event of premature detonation thereof.

21. A detonator as in claim 20 wherein the first liquid component comprises nitroparaffin, the second liquid component comprises hydrazine and the delayed acting sterilising agent comprises diethylenetriamine.

* * * * *